US007449433B1

(12) United States Patent
Honary et al.

(10) Patent No.: US 7,449,433 B1
(45) Date of Patent: Nov. 11, 2008

(54) RIGID STRUCTURE LUBRICANT

(75) Inventors: Lou A. T. Honary, Waverly, IA (US); Craig Shore, Grinnell, IA (US)

(73) Assignee: Environmental Lubricants Mfg., Inc., Plainfield, IA (US)

( * ) Notice: Subject to any disclaimer, the term of this patent is extended or adjusted under 35 U.S.C. 154(b) by 745 days.

(21) Appl. No.: 10/908,712

(22) Filed: May 24, 2005

(51) Int. Cl.
*F16C 33/20* (2006.01)
*F16C 33/18* (2006.01)
*C10M 169/04* (2006.01)

(52) U.S. Cl. ..... 508/491; 508/100; 508/101

(58) Field of Classification Search ..... 508/100, 508/101, 491, 490
See application file for complete search history.

(56) References Cited

U.S. PATENT DOCUMENTS 6,649,573 B2 11/2003 Mitrovich

OTHER PUBLICATIONS

U.S. Appl. No. 10/655,082, filed Sep. 3, 2003, Mitrovich.
U.S. Appl. No. 10/812,666, filed Mar. 29, 2004, Mitrovich.
U.S. Appl. No. 10/310,211, filed Dec. 5, 2002, Mitrovich.
Kelsan Technologies Corp.; Promotional Literature.

*Primary Examiner*—Walter D Griffin
*Assistant Examiner*—Frank C Campanell
(74) *Attorney, Agent, or Firm*—Ryan N. Carter

(57) ABSTRACT

A rigid structure comprising a lubricant, an absorbent material, and a reinforcing material. The reinforcing material may be comprised of a fibrous and/or a plastic material. The absorbent material is comprised of a fibrous material. The lubricity and wear rate of the rigid structure can be controlled by changing the amount of lubricant contained in the rigid structure in relation to the amount of reinforcing and/or absorbent material contained in the rigid structure. In some embodiments, the lubricity and wear rate of the rigid structure can also be controlled by changing the amount of reinforcing material in relation to the amount of absorbent material.

26 Claims, 6 Drawing Sheets

RIGID STRUCTURE LUBRICANT

BACKGROUND OF THE INVENTION

Many industries have struggled to find a lubricant that contains suitable lubricating properties and is easily deliverable onto the part being lubricated. Some industries find that a lubricant having ideal properties is not available in a form suitable for proper delivery. For example, a liquid lubricant may contain ideal lubricating properties, but it may be difficult to introduce a liquid lubricant onto the parts that need lubricating.

One industry that has struggled to find effective lubricants is the railroad industry. One reason for this struggle is because of the wide range of temperatures and frictions that lubricants used on trains must endure. For example, in the Midwest, lubricant is needed on trains that function when the temperature is ninety degrees Fahrenheit in the summer months, and zero degrees Fahrenheit in the winter months. For over fifty years railroads have used a variety of methods to reduce the wear caused by friction between the wheel flanges and the gauge face of the rail with which it comes into contact. Wear is caused when a wheel flange contacts the gauge face of the track when the car is passing through a curve or when the car moves from side-to-side while moving down a straight track. Railroads and transits have realized they can save substantial amounts of money in lowered maintenance and equipment replacements if lubrication is applied. Reducing friction by lubrication results in fuel savings due to reduced drag forces and also in noise reduction due to elimination of metal to metal contact by a thin film of lubricant.

Several methods have been used in the railroad industry, including one method wherein liquid lubricant is sprayed onto the wheel flange of the locomotive. Lubricant is then passed back through the train as successive wheels come in contact with the rail and pick up some of the lubricant. There are several problems associated with the use of liquid lubricant, even though the liquid lubricant may contain suitable lubricating properties. One problem with this spray method is that it is difficult to control where the sprayed lubricant is applied. The lubricant can be inadvertently sprayed on top of the rail which can cause the train wheels to slip inhibiting the friction needed to propel the train forward or to slow or stop the train. Further, maintenance time and expenses for keeping oil spray devices in working order has been found to be excessive.

An alternative method for applying lubricant to train wheel flanges has been to use a solid lubricant stick or rod. The stick or rod lubricant is applied by various mechanical means to the flanges of the wheel of a locomotive or railcar. Such prior art solid lubricants also have several inherent problems, even though they may contain suitable lubricating properties. First, it is difficult to control the rate at which the stick lubricant "wears" against the train wheel or other industrial article because of varying wheel speeds, friction, and heat produced by the locomotive or the railcar wheels. If the lubricant stick wears too slowly, the wheel flange may be inadequately lubricated, if the lubricant stick wears too quickly, the lubricant may be inefficiently wasted causing it to be used too quickly. In an effort to control the wear rate of solid lubricants, many prior art solid lubricants have added environmentally hazardous metallic powders because of their anti-wear properties. The problem with these metallic powders is that they represent a hazard to the environment as well as to the railroad workers.

Other industries have encountered similar problems wherein they require a suitable delivery means for applying the appropriate solid, semi-solid, or liquid lubricant that is safe to use. Therefore, there is a need for a lubricant delivery means adapted for allowing the control of the lubricity and the safe wear rate of the lubricant regardless of whether the lubricant is solid, semi-solid, or liquid.

SUMMARY OF THE INVENTION

The present invention is for a rigid structure comprising a lubricant, a reinforcing material, and sometimes an absorbent material. The rigid structure is adapted for application by contact to industrial articles such as the wheel flange of a railroad car. Many of the applications for the lubricant described herein refer to locomotive applications; however, the present invention is useful in any application where lubricant application is desirable, particularly where a lubricant is applied to a moving article such as a chain, gear, or wheel.

The present invention comprises several different embodiments wherein the rigid structure provides a means for applying lubricant to the article. In certain embodiments, the lubricant used in the rigid structure of the present invention can be either solid, semi-solid (grease), or liquid. The absorbent serves as a carrier (wick) for the delivery of the lubricant during application to the article. The absorbent material also provides rigidity to the structure. The reinforcing material supports the absorbent and lubricant, and controls the wear of the rigid structure regardless of the state of matter or melting point of the lubricant. Without a reinforcing material, the lubricant may wear against the article being lubricated at an uncontrolled rate resulting in wasted lubricant and inadequate lubrication if the use is mobile or in a remote locale where the lubricant stick may not be readily replaced.

The reinforcing material contained in the rigid structure is generally comprised of a fibrous material and/or a plastic material (hereinafter collectively referred to as "reinforcing material") that has wear resistant properties, that is, a wear rate that is less than that of the lubricant. The wear rate and the lubricity of the rigid structure can be controlled by varying the amount of lubricant in relation to the amount of reinforcing material in the rigid structure. Specifically, adjusting the amount of reinforcing material and/or absorbent material in the rigid structure allows the user to adjust the lubricity wherein adding a greater concentration of reinforcing material and/or absorbent material to the structure reduces lubricity and reduces the rate of wear, and reducing the concentration of reinforcing material and/or absorbent material in the structure increases lubricity and increases the rate of wear. In certain embodiments, the plastic reinforcing material is a thermoplastic such as a high density polyethylene. The reinforcing plastic could also be a thermoset plastic, and either plastic could be bio-based or derived from fossilized materials. In certain embodiments wherein the reinforcing material is fibrous, the fiber is a natural fiber, but it could also be a synthetic fiber such as glass fiber or carbon fiber.

The lubricant can be any suitable lubricant, whether petroleum based or bio-based. In certain embodiments the lubricant is grease derived from vegetable oils or other biodegradable esters. The preferred lubricant is suitable for "lost-in-use" applications because the biobased lubricant is biodegradable, and, thus, less harmful to the environment than conventional petroleum based lubricants. Additionally, biobased lubricant has been found to have superior lubricating properties over a wide range of variable temperatures.

The absorbent contained in the rigid structure is generally comprised of a fibrous material. The absorbent material is functional by first absorbing the lubricant, then acting as a delivery carrier (wick) for the lubricant during application to the article. Increasing or decreasing the amount of absorbent material used also affects the rigidity of the structure. The relative size of the absorbent material can be varied to affect the amount of lubricant absorbed, and the structural characteristics—typically more exposed surface area increases the absorption of the lubricant. In certain embodiments the absorbent material is comprised of a natural fiber material such as cotton, industrial hemp, kenaf. Other absorbent materials may include fabric materials such as virgin or recycled fabric or textile materials.

In certain embodiments, the absorbent material is comprised of the same material as the reinforcing material (since the reinforcing material may be fibrous). In these embodiments the fibrous material in the rigid structure serves the reinforcing function of the reinforcing material and the wicking function of the absorbent material.

As described below, the present invention has several embodiments for controlling the rate at which the lubricant wears against the article being lubricated. It should be noted that one or more of the embodiments can be used at the same time to control the lubricity and wear rate of the rigid structure. One embodiment is to homogonously combine a lubricant and reinforcing material to form the rigid structure. As described above, the amount of reinforcing material in relation to the amount of lubricant can be increased or decreased so as to increase or decrease the rigidity and wear rate of the structure. An absorbent may also be used with this embodiment to aid in wicking the lubricant onto the article.

An alternate embodiment is to form the structure, such as with a form or mold, so that the structure comprises an internal lattice having a plurality of cavities. The lattice structure is comprised of the reinforcing material that typically has a wear rate that is less than that of the lubricant. The lattice cavities are filled with solid, semi-solid, or liquid lubricant. The lattice cavities act as a reservoir for the lubricant and provide a means for controlling the wear rate of the structure which can be changed by varying the density or thickness of the lattice walls. The denser the lattice, the slower the structure wears against the article. As the structure is worn down by friction with the article, more cavities are exposed to the article thereby revealing the article to more lubricant. An absorbent may also be used with this embodiment to aid in wicking the lubricant onto the article.

Yet another embodiment for controlling the wear rate of the lubricant is to encase the lubricant (or the rigid structure from other embodiments described herein) inside of a casing made of a material that wears more slowly than the lubricant. In this embodiment the casing is made of the reinforcing material, which is preferably plastic in this embodiment. The thickness and/or hardness of the casing can be increased or decreased so as to vary the wear rate of the structure. Additional benefits of encasing the lubricant include reduction of odor, improved cleanliness during application, and the option of color coded casings for identification. An absorbent may also be used with this embodiment to aid in wicking the lubricant onto the article.

Yet another embodiment for controlling the wear rate of the rigid structure is to combine the rigid structure with longitudinal wear bars, which are preferably enclosed within the rigid structure lubricant body. In this embodiment, the wear bars are comprised of the reinforcing material. The internal wear bars extend the length of the rigid structure. The rate of wear can be controlled by adding more wear bars, or by making the wear bars thicker or denser. An absorbent may also be used with this embodiment to aid in wicking the lubricant onto the article.

The present invention allows control over the wear rate and lubricity of the lubricant regardless of whether the lubricant is solid, semi-solid, or liquid. This offers an economic advantage because the user can better control the rate at which the lubricant is applied. Further, the user can choose the lubricant that has the best lubrication properties for the desired applications while being assured of a controlled delivery.

DESCRIPTION OF THE PREFERRED EMBODIMENT OF THE INVENTION

Figure 5:
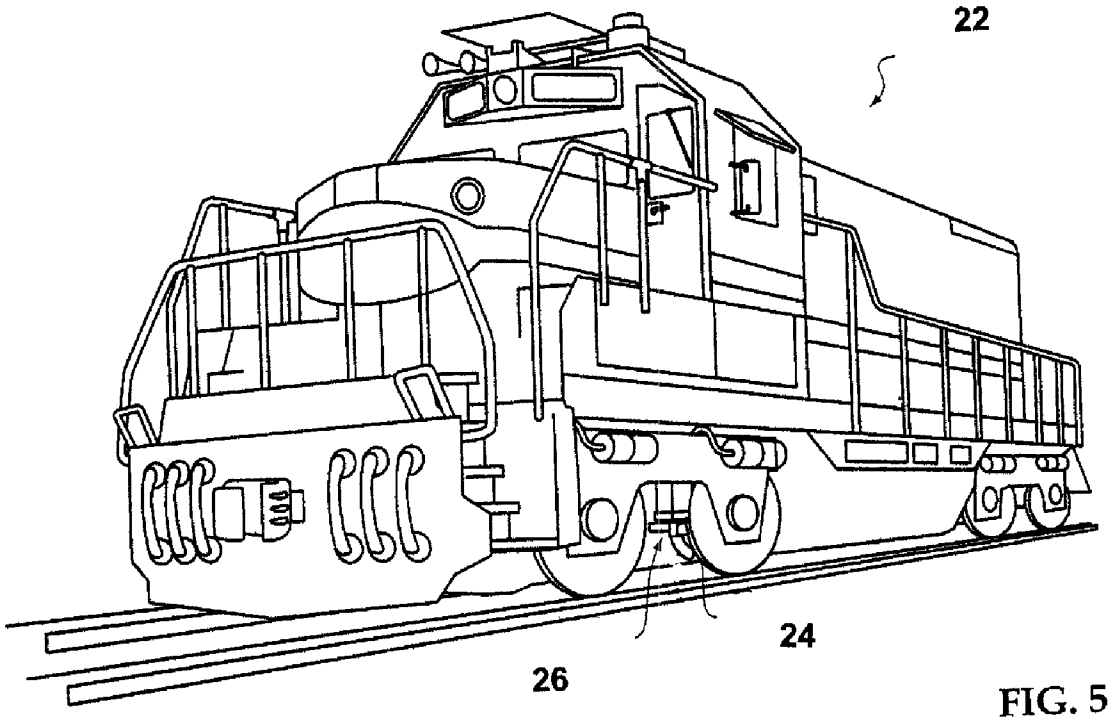
FIG. 5 is a perspective view of the rigid structure of the present invention in proximity to the wheel flange of a locomotive.
Figure 6:
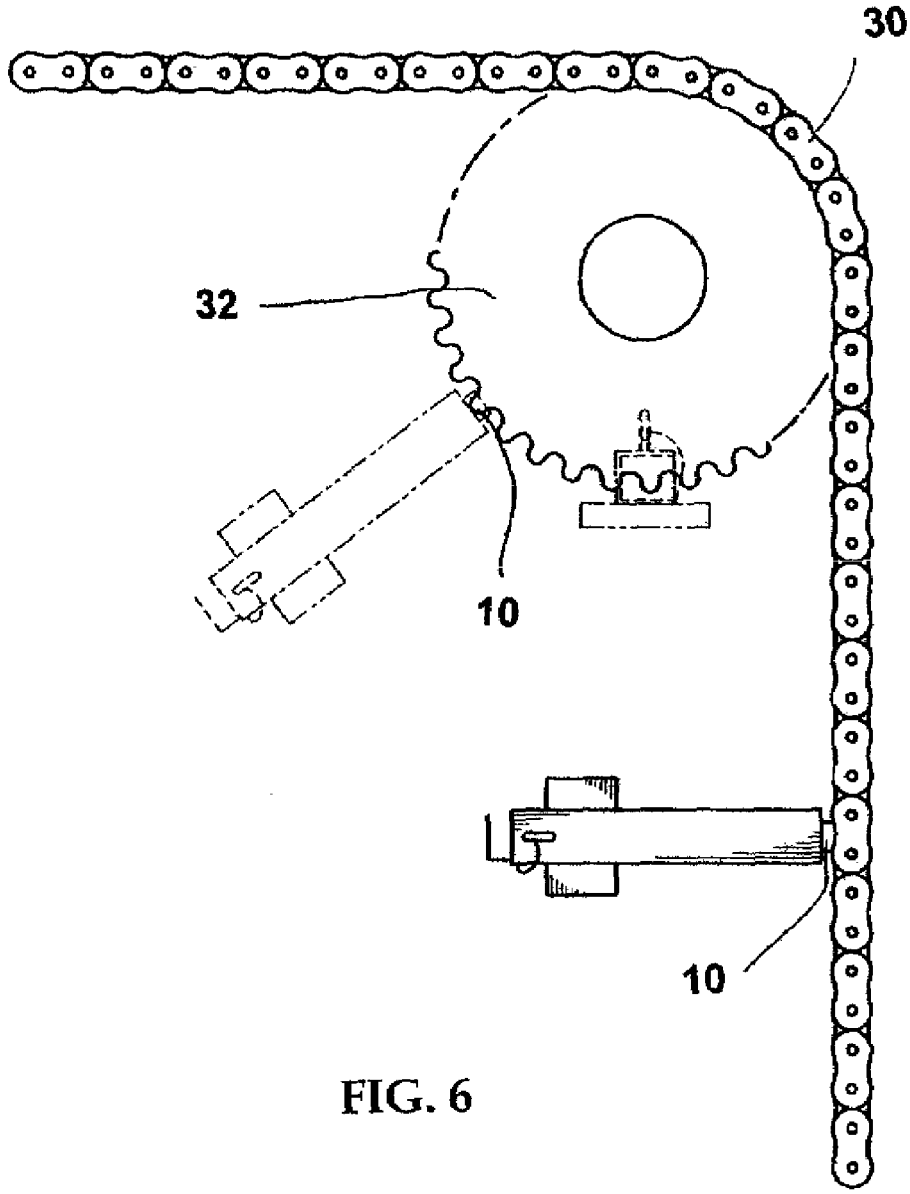
FIG. 6 is a schematic view of the rigid structure of the present invention being applied to lubricate a heavy-duty chain.

The present invention is for a rigid structure 10 wherein the structure 10 comprises a lubricant, a reinforcing material for controlling the wear rate of the structure 10, and sometimes an absorbent material for aiding in the delivery of the lubricant. The rigid structure 10 of the present invention is preferably for direct contact lubrication of industrial articles. FIGS. 5 and 6 show examples of various applications for the rigid structure 10 described herein. FIG. 5 shows the structure 10 applied to the flange of a locomotive wheel 24, and FIG. 6 shows an alternate application wherein the structure 10 is applied to a moving chain 30 or sprocket 32. The rigid structure 10 can be applied using an applicator similar to the one described in U.S. patent Ser. No. 10/310,211. Applicators such as the one disclosed in U.S. patent Ser. No. 10/310,211 function similarly to a manual stapler, wherein a stick or multiple sticks of stables are loaded into the stapler and advanced to the dispensing end by a spring assembly or some similar means.

The structure 10 comprises a reinforcing material which is preferably comprised of fiber and/or plastic. The reinforcing material generally comprises a wear rate that is slower that the lubricant. In the embodiments where the reinforcing material is comprised of a fiber, the fiber is preferably a natural fiber material such as cotton, industrial hemp, kenaf, or other fabric materials such as virgin or recycled fabric or textile materials. In other embodiments the reinforcing material may be comprised of a plastic material which can be used either instead of, or in combination with the fibrous reinforcing material. If plastic is used, it is preferably a thermoplastic or thermo-set plastic material. The plastic can be bio-based or derived from fossilized materials.

The reinforcing material serves to control the wear rate of the rigid structure 10 as well as the lubricity of the rigid structure 10. Controlling the wear rate of a lubricant is important because lubricants with superior lubricating properties may have low melting points (or may even be liquids) which would melt and/or apply themselves too quickly if they were not restrained. The present invention allows better control of the wear rate of the lubricant regardless of the lubricant's properties. The amount of lubricant in relation to the amount of reinforcing material in the rigid structure controls the wear rate of the rigid structure as well as the degree of lubricity contained in the rigid structure 10. Specifically, adjusting the amount of reinforcing material in the rigid structure 10 allows the adjustment of the degree of lubricity wherein adding a greater concentration of reinforcing material to the structure 10 reduces lubricity and reduces the rate of wear, and reducing the concentration reinforcing material in the structure 10 increases lubricity and increases the rate of wear.

The delivery of the lubricant is aided by the absorbent material which acts as a wick by absorbing some of the lubricant and then applying it to the moving article. The relative size of the absorbent material can be varied to affect the amount of lubricant absorbed, and the structural characteristics—typically more exposed surface area increases the absorption of the lubricant. In certain embodiments, the fiber pieces having a maximum fiber length between ⅛ inch and one inch. In certain embodiments, the absorbent material is comprised of the same fibrous material as the reinforcing material. In these embodiments the fibrous material serves the functions of the reinforcing material as well as the wicking function of the absorbent material.

In the embodiments where the reinforcing material is plastic and the rigid structure 10 includes an absorbent material, the wear rate and lubricity of the rigid structure 10 can be controlled by altering the relative amounts of plastic reinforcing material in relation to the amount of fibrous absorbent material. In these embodiments, increasing the amount of plastic reinforcing material and decreasing the amount of fibrous absorbent material in relation to the amount of lubricant contained in the rigid structure decreases lubricity of the structure 10 and decreases the rate at which the structure 10 wears against the article. Conversely, decreasing the amount of plastic reinforcing material and increasing the amount of fibrous absorbent material contained in the rigid structure 10 in relation to the amount of lubricant increases lubricity of the structure 10 and increases the rate at which the structure 10 wears against the article.

As discussed above, the structure 10 of the present invention comprises a lubricant for lubricating the article onto which the structure 10 is applied. Lubricants used in the present invention can be solid (including powder), semi-solid (grease), or liquid, depending on the particular embodiment. The lubricant can be derived from any suitable material, including petroleum or bio-based products; however the preferred lubricant is a grease that is derived from vegetable oil such as soybean oil based grease thickened by any variety of soap thickeners such as lithium or lithium complex, clay, or aluminum complex. Other bio-based lubricants that can be used include biodegradable esters or lithium complex-thickened grease, calcium based grease, polyurea based or titanium complex. The preferred environmentally friendly bio-based biodegradable lubricants makes the invention particularly suited for "lost-in-use" or "total loss" applications, such as application to the moving wheel flange 25 of a train 22, as shown in FIG. 5.

The present invention includes several embodiments for controlling the wear rate of the rigid structure 10 by combining the lubricant with a reinforcing material, and sometimes an absorbent material. It should be noted that the embodiments can be used either alone, or in combination with other embodiments. A combination of several of the embodiments may be particularly useful if an extremely slow wear rate is desired.

Figure 1:
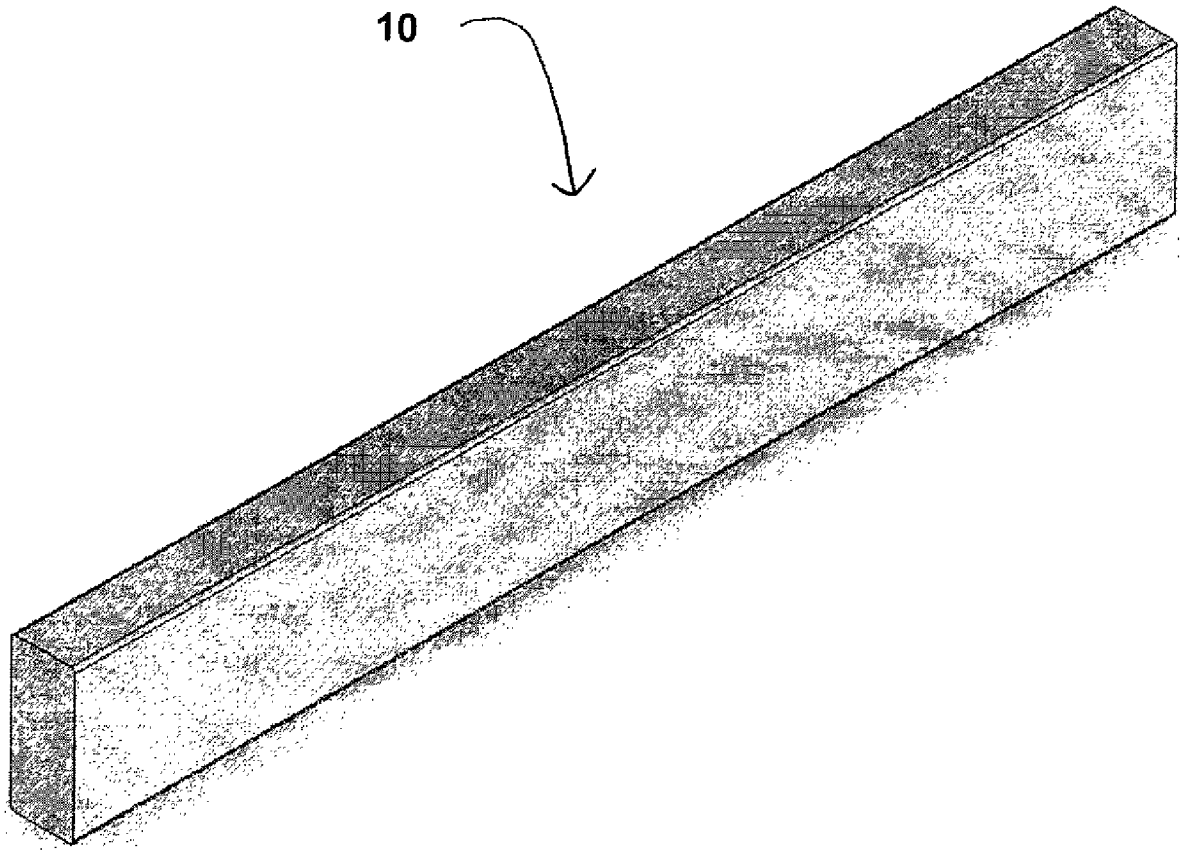
FIG. 1 is a perspective view of the rigid structure wherein the lubricant is homogonously combined with the reinforcement material and sometimes an absorbent material.

The first embodiment is shown in FIG. 1 wherein the lubricant is homogenously combined with a reinforcing material to form the rigid structure 10. An absorbent may also be used with this embodiment to aid in wicking the lubricant onto the article. In this first embodiment, the absorbent material may be a biobased fibrous material and the reinforcing material may be plastic. The reinforcing material of this first embodiment helps to slow the wear of the rigid structure 10 as described above.

Figure 2:
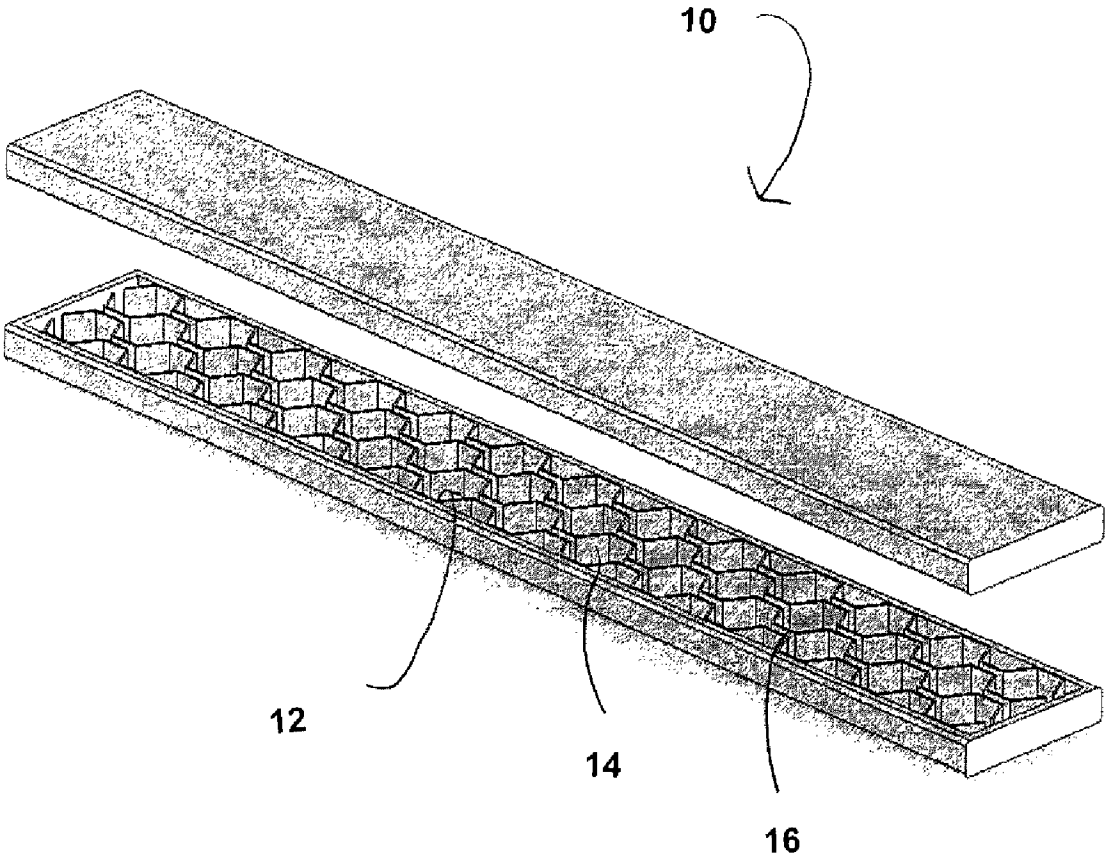
FIG. 2 is a perspective view of the lattice structure inside the rigid structure.

A second embodiment for controlling the wear rate of the rigid structure 10 is shown in FIG. 2, wherein the inside of the structure 10 comprises a lattice 12. The inside of the structure 10 comprises a plurality of lattice walls 16 which form a plurality of lattice cavities 14. Solid, semi-solid, or liquid lubricant is introduced into the lattice cavities 14, which act as a reservoir for the lubricant. As the second embodiment's rigid structure 10 is worn away by friction with the article being lubricated, more of the cavities 14 are exposed thereby allowing more lubricant to be applied to the article.

In the second embodiment, the lattice walls 16 are comprised of a reinforcing material that is denser than the lubricant so as to have a wear rate that is slower than that of the lubricant. The lattice walls 16 may be comprised of a natural fiber. The increased density of the lattice structure 12 provides a means of controlling the wear rate which is determined by the density of the lattice material and/or the thickness of the lattice walls 16. The denser and thicker the structure of the lattice 12, the slower the rigid structure 10 will wear and the slower lubricant will be released from the individual cavities 14. Conversely, the less dense and thinner the lattice structure 12, the faster it will wear and the faster lubricant will be released from the individual cavities 14. An absorbent may also be used with this embodiment to aid in wicking the lubricant onto the article.

Figure 4:
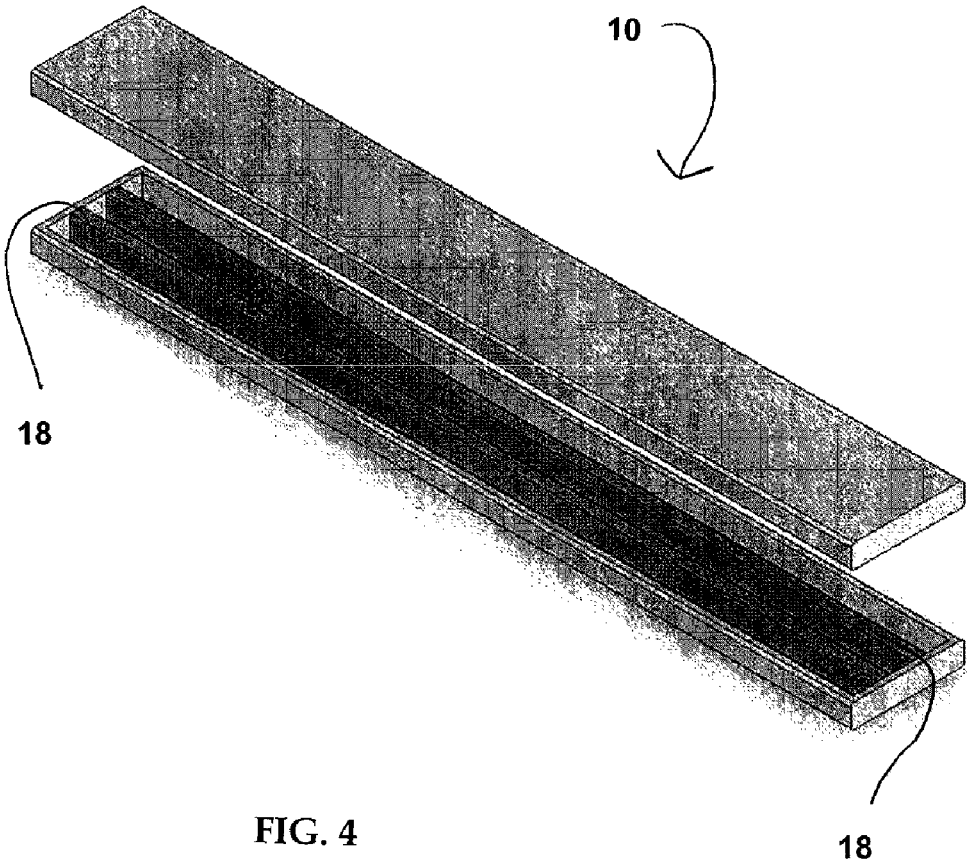
FIG. 4 is a top perspective view of the rigid structure showing the wear bars embedded inside the rigid structure.

FIG. 4 shows a third embodiment for controlling the wear rate of the rigid structure 10. FIG. 4 shows wear bars 18 which extend the length of the structure 10. In the preferred method of the third embodiment, the wear bars 18 are embedded inside the rigid structure 10 so that the rigid structure 10 cannot wear at a rate faster than the wear bars 18. These wear bars 18 are comprised of a reinforcing material. The rate of wear can be changed by increasing the thickness, number, or hardness of the wear bars 18. This third embodiment is typically used along with the first embodiment wherein the lubricant and reinforcing material is homogonously mixed in the structure 10. An absorbent may also be used with this embodiment to aid in wicking the lubricant onto the article.

Figure 3:
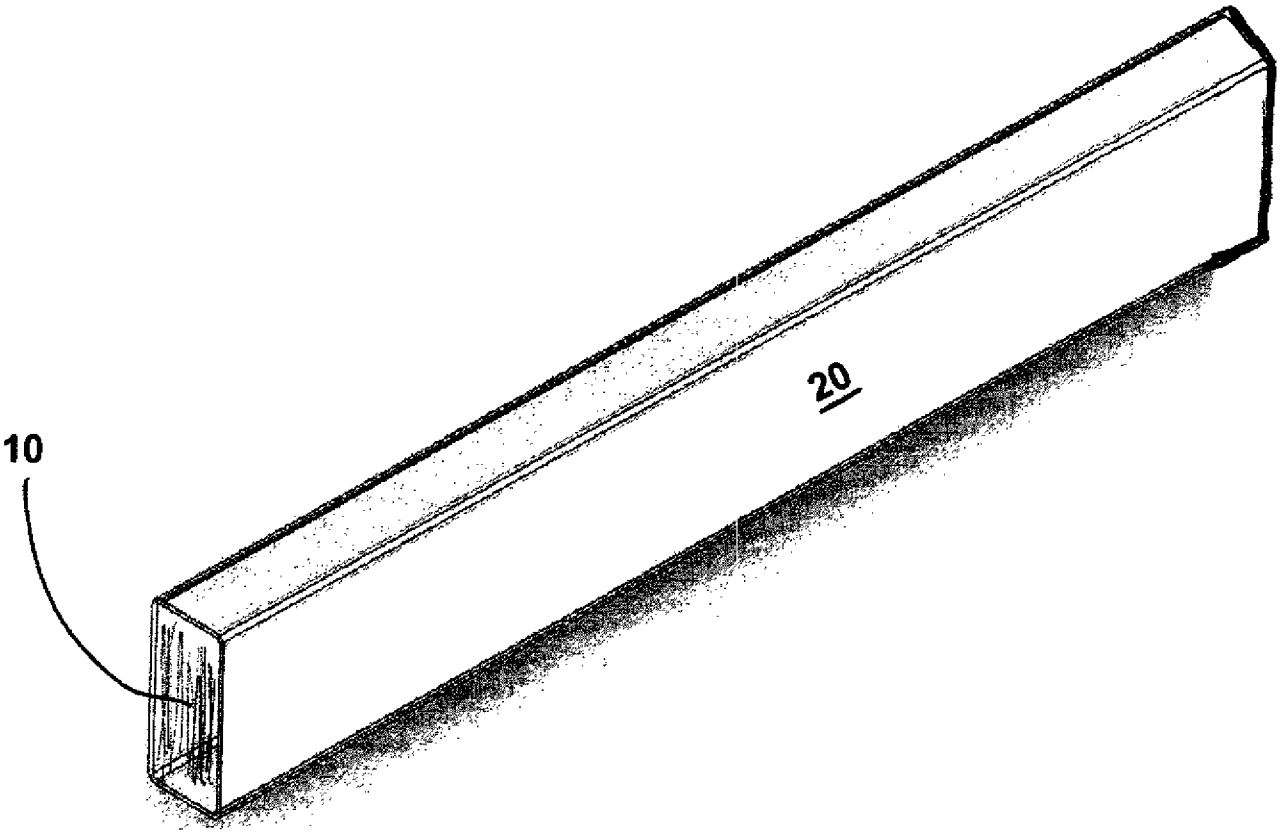
FIG. 3 is a perspective view of the lubricant and/or rigid structure enclosed in a casing.

FIG. 3 shows a fourth embodiment for controlling the wear rate of the rigid structure 10. In this embodiment, the structure 10 is enclosed inside of a casing 20. The casing 20 is made from a reinforcing material, which is preferably plastic in this embodiment. The wear rate of the casing 20 can be controlled independently from the composition of the structure 10 by increasing the hardness, thickness, or type of plastic used in the casing 20. This allows the user to use a lubricant with desired lubricating properties without regard to the lubricant's wear rate. In addition to controlling the wear rate, the casing 20 provides additional benefits. One such benefit is that the casing 20 helps to reduce the odor that is often produced by melting lubricants. The casing 20 also helps to improve cleanliness during application. In this embodiment the casing 20 can be color coded so as to indicate the wear rate of the particular casing composition. For example, a green casing 20 can be used to indicate that the lubricant and casing 20 wear at a relatively fast rate, and a red casing 20 could be used to indicate a relatively slow wear rate. Trade names and other marking could also be printed on the casings 20 more easily than if the lubricant product is not encased. Also, the color coded casing can be imprinted with instructions, product information, and other information. An absorbent may also be used with this embodiment to aid in wicking the lubricant onto the article.

The process for manufacturing and using one of the embodiments may include the following steps:

first provide an absorbent natural fiber material of controlled relative size;

heating a biobased grease lubricant to decrease its viscosity;

mixing the absorbent natural fiber and the heated lubricant mix in high density polyethylene to act as a reinforcing material, and melt to liquid state, per the specification sheet of selected high density polyethylene;

allow the combination to cool and form rigid structures of a predetermined shape;

applying the rigid structure 10 to the object to be lubricated;

in some embodiments it may be desirable to modify the above process to provide for an external casing, or internal wear bars or still other means to regulate the wear rate of the rigid structure 10.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A rigid structure adapted for lubricating a moving article by contact of the rigid structure with the article, said rigid structure comprising:

a lubricant;

an absorbent material adapted to act as a carrier to aid in the delivery of the lubricant to the article; and a reinforcing material combined with the lubricant;

wherein increasing an amount of reinforcing material in relation to an amount of lubricant contained in the rigid structure decreases lubricity of the rigid structure and decreases a rate at which the rigid structure wears against the article, and decreasing an amount of reinforcing material contained in the rigid structure in relation to an amount of lubricant increases lubricity of the structure and increases a rate at which the structure wears against the article.

2. The rigid structure lubricant of claim 1 wherein the absorbent material is adapted to enhance the rigidity of the rigid structure so that increasing an amount of absorbent material in relation to an amount of lubricant contained in the rigid structure decreases lubricity of the rigid structure and decreases a rate at which the rigid structure wears against the article, and decreasing an amount of absorbent material contained in the rigid structure in relation to an amount of lubricant increases lubricity of the structure and increases a rate at which the structure wears against the article.

3. The rigid structure lubricant of claim 1 wherein increasing an amount of reinforcing material and decreasing an amount of absorbent material in relation to an amount of lubricant contained in the rigid structure decreases lubricity of the structure and decreases a rate at which the structure wears against the article, and decreasing an amount of reinforcing material and increasing an amount of absorbent material contained in the rigid structure in relation to an amount of lubricant increases lubricity of the structure and increases a rate at which the structure wears against the article.

4. The rigid structure of claim 1 wherein the lubricant is homogenously combined with an absorbent material and a reinforcing material.

5. The rigid structure of claim 1 further comprising a casing adapted to receive the rigid structure, wherein the casing is made of the reinforcing material.

6. The rigid structure of claim 1 further comprising at least one wear bar combined with the structure, said wear bar being made of the reinforcing material.

7. The rigid structure of claim 1 wherein the reinforcing material is comprised of plastic and the absorbent material is porous.

8. The rigid structure of claim 1 wherein the reinforcing material is comprised of plastic of high density polyethylene material.

9. The rigid structure of claim 1 wherein the absorbent material is porous and comprised of a natural fiber material.

10. The rigid structure of claim 7 wherein the plastic is thermoset plastic.

11. The rigid structure of claim 7 wherein the plastic is bio-based.

12. The rigid structure of claim 7 wherein the plastic is derived from fossilized materials.

13. The rigid structure of claim 7 wherein the plastic is thermoplastic.

14. The rigid structure of claim 7 wherein the absorbent material is a natural fiber material.

15. The rigid structure of claim 7 wherein the absorbent material is a natural nonfiber material.

16. The rigid structure of claim 7 wherein the absorbent material is a synthetic fiber material.

17. The rigid structure of claim 7 wherein the absorbent material is a synthetic nonfiber material.

18. The rigid structure of claim 1 wherein the reinforcing material is fibrous.

19. The rigid structure of claim 1 wherein the lubricant is solid.

20. The rigid structure of claim 1 wherein the lubricant is powder.

21. The rigid structure of claim 1 wherein the lubricant is grease.

22. The rigid structure of claim 1 wherein the lubricant is liquid.

23. The rigid structure of claim 1 wherein the lubricant is comprised of a biodegradable lubricant.

24. The rigid structure of claim 1 wherein the lubricant is derived from vegetable oils.

25. A rigid lubricating structure for lubricating a wheel flange on a railroad vehicle by contact of the rigid lubricating structure with the wheel flange, said rigid lubricating structure comprising:

means for lubricating;

means for creating a homogeneous mixture containing said means for lubricating so as to form a rigid lubricating structure;

means for wicking the means for lubricating so as to transport said means for lubricating within the rigid lubricating structure;

said means for lubricating and said means for creating a homogeneous mixture further configured so that increasing an amount of the means for creating a homogeneous mixture in relation to an amount of the means for lubricating contained in the rigid lubricating structure decreases lubricity of the rigid lubricating structure and decreases a rate at which the rigid lubricating structure wears against the wheel flange, and decreasing an amount of means for creating a homogeneous mixture contained in the rigid lubricating structure in relation to an amount of means for lubricating increases lubricity of the rigid lubricating structure and increases a rate at which the rigid lubricating structure wears against the wheel flange; means for retarding wear of the rigid lubricating structure in combination with the homogeneous mixture which is not homogeneous with respect to the means for lubricating.

26. A lubricating structure for lubricating a wheel flange of a rail car, the lubricating structure comprising:

a composite matrix comprising;

(a) a bio-based lubricant;

(b) a plurality of natural fiber pieces, having a maximum fiber length between ⅛ inch and one inch, for absorbing the bio-based lubricant and performing a wicking function with respect to said bio-based lubricant;

(c) a high density polyethylene binding agent for structurally reinforcing the lubricating structure; and a casing around said composite matrix, said casing having a mechanical wear resistance characteristic which is greater than a mechanical wear resistance characteristic of said composite matrix.

* * * * *